United States Patent [19]

Rietzscher et al.

[11] Patent Number: 4,711,290

[45] Date of Patent: Dec. 8, 1987

[54] METHOD AND APPARATUS FOR CASTING IRON TREATED WITH MAGNESIUM

[75] Inventors: Rolf Rietzscher, Mettmann; Stefan Dersch, Solingen, both of Fed. Rep. of Germany; Max Riethmann, Ermatingen, Switzerland

[73] Assignee: George Fischer Ltd., Schaffhausen, Switzerland

[21] Appl. No.: 830,104

[22] Filed: Feb. 18, 1986

[30] Foreign Application Priority Data

Feb. 18, 1985 [CH] Switzerland ..... 735/85

[51] Int. Cl.[4] ..... B22D 23/00

[52] U.S. Cl. ..... 164/66.1; 164/119; 164/154; 164/259; 164/306

[58] Field of Search ..... 164/57.1, 58.1, 59.1, 164/66.1, 67.1, 119, 154, 155, 259, 306

[56] References Cited

FOREIGN PATENT DOCUMENTS 2645896 4/1978 Fed. Rep. of Germany ..... 164/57.1

55-48467 4/1980 Japan ..... 164/306

*Primary Examiner*—M. Jordan

*Assistant Examiner*—Richard K. Seidel

*Attorney, Agent, or Firm*—Walter C. Farley

[57] ABSTRACT

A casting furnace is fed an inert gas under pressure through a feed line with the pressure being regulated by a melt level control device. When the pressure is reduced, the inert gas is exhausted from the casting furnace by an exhaust line, the feed line having a check valve to prevent gas which is contaminated by magnesium from entering the feed line. An oxidizing gas, preferably pressurized air, is periodically fed into the exhaust line by an oxidizing gas line for cleaning the drain line and the pressure-controlling aperture therein by oxidizing the magnesium.

12 Claims, 1 Drawing Figure

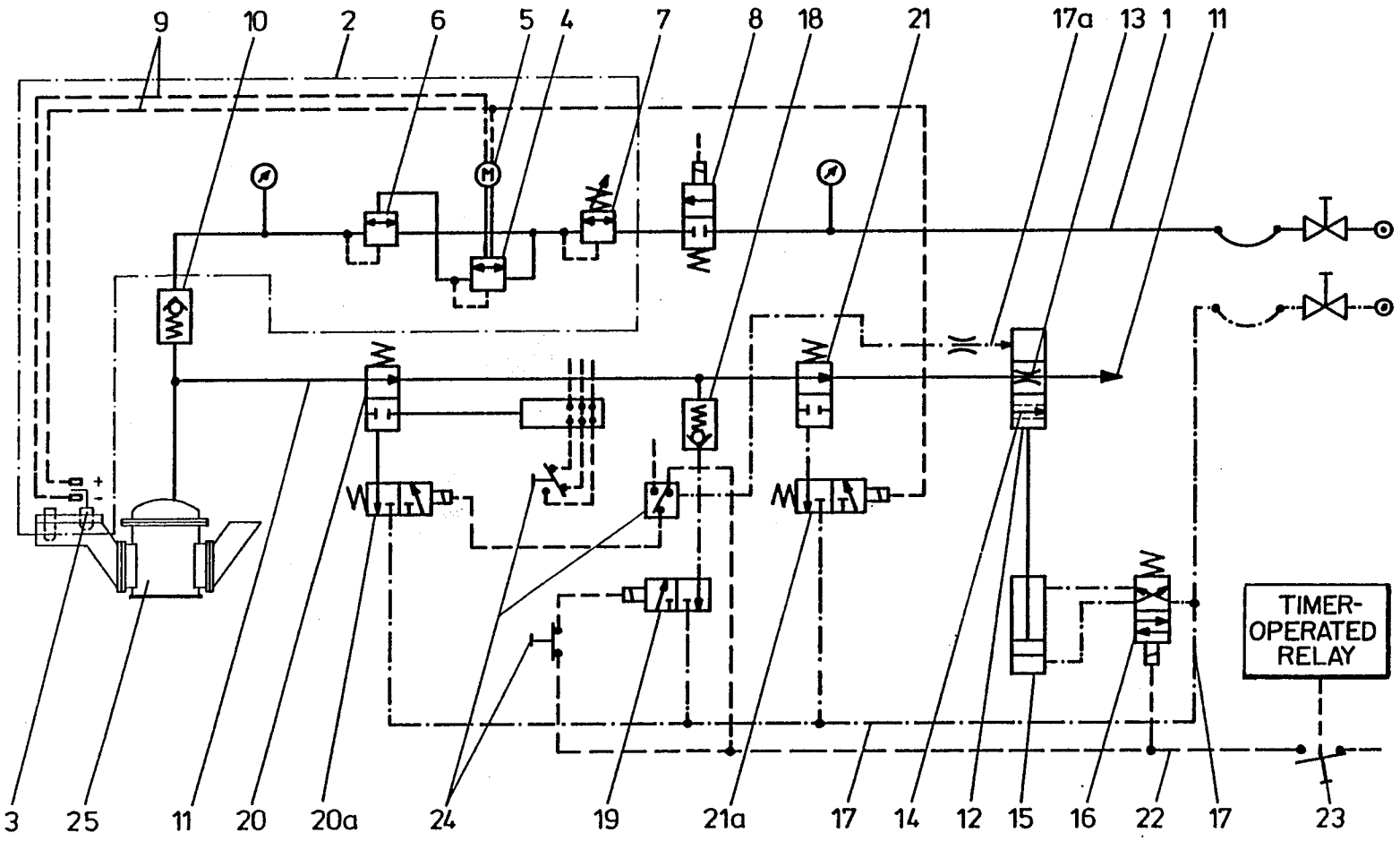
TIMER-OPERATED RELAY
11
1
13
17a
21
18
8
7
4
5
6
2
10
9
23
17
22
16
15
12
14
17
21a
19
24
20a
20
11
25
3

METHOD AND APPARATUS FOR CASTING IRON TREATED WITH MAGNESIUM

This invention relates to a method for casting iron treated with magnesium to permit the safe oxidization of condensed magnesium in gas lines associated with the casting apparatus, and to an apparatus for performing the method.

BACKGROUND OF THE INVENTION

Pressure gas-activated casting apparatus for casting cast iron (gray iron) and malleable cast iron are generally known and have been widely used. To a much lesser degree, such casting apparatus have also been used for casting iron treated with magnesium. In many cases, these casting apparatus use blend operations, i.e. cast iron or malleable cast iron are cast along with iron that is treated with magnesium.

Casting with such types of pressure gas casting apparatus requires precise control operations of the furnace pressure, meaning that the pressure is increased and decreased by means of control devices having small cross sections. It is known that magnesium from the rapidly cooling inert gas flowing out of the furnace condenses and is deposited in the piping of the control and regulatory system, particularly where the flow passages narrow, such as in valves, apertures, and the like, particularly when larger proportions of magnesium-treated iron are cast in relation to the total volume of iron. Because of their high degree of flammability and their tendency to explode, these deposits represent safety risks for the maintenance personnel when the equipment if periodically cleaned and serviced. This danger particularly exists when portions of the deposited magnesium are dislodged during the maintenance and cleaning work. Especially thick deposits lead to explosions. Thus, these thick deposits cannot be allowed to form. Only the external coating of such a thick deposit can be oxidized. Once that coating is removed, an explosion results.

BRIEF SUMMARY OF THE INVENTION

Accordingly, an object of the present invention is to provide a method for casting iron treated with magnesium such that the piping and valve system associated with the casting apparatus and which has been contaminated with magnesium is rendered safe to be cleaned, the process being usable even during the casting process.

A further object is to provide an apparatus which is controllable to render the magnesium deposits in piping of the casting apparatus safe so that it can be cleaned.

Briefly described, the invention includes a method of casting iron treated with magnesium in a casting apparatus operated with gas under pressure, the apparatus being of the type having a casting furnace and a piping system for delivering inert gas under pressure to the casting furnace and wherein inert gas flowing back from the casting furnace is enriched with magnesium including restricting the back flow of inert gas to a selected, limited portion of the piping system so that magnesium condensing out of the gas is restricted to the selected portion, and periodically oxidizing condensed magnesium in the selected portion of the piping system without interrupting the casting process.

In another aspect, the invention comprises an apparatus for casting iron treated with magnesium in an atmosphere of inert gas under pressure comprising the combination of a casting furnace, a feed line for delivering inert gas to the casting furnace, level sensor means responsive to melt level in the furnace for producing a feed line pressure control signal, an exhaust line for removing inert gas from the furnace, a check valve in the feed line for preventing flow of gas into the feed line from the furnace, and an oxidizing gas line connected to the exhaust line so that condensed magnesium in the exhaust line can be oxidized by periodically passing oxidizing gas through the exhaust line without interrupting the casting process.

BRIEF DESCRIPTION OF THE DRAWING

In order to impart full understanding of the manner in which these and other objectives are attained in accordance with the invention, a particularly advantageous embodiment thereof will be described with reference to the accompanying drawing, which forms a part of this specification, and which shows a schematic diagram of a pressure gas-activated casting apparatus, the drawing having dash-dot lines representing conduits carrying oxidizing gas, solid lines representing conduits carrying inert gas and dashed lines representing electrical interconnections.

DESCRIPTION OF THE PREFERRED EMBODIMENT

As seen in the FIGURE, the casting apparatus uses a casting furnace 25 which receives material to be cast and which discharges molding material into moulds in a conventional manner, not shown, such as by opening and closing a controlled plug.

In order to control the level of the melt in the casting furnace 25, an inert gas, such as nitrogen, is introduced through a feed line 1. A level control mechanism, which is enclosed within a phantom line and identified by the reference numeral 2, includes a level sensing transducer 3, a pressure adjustment valve 4 having an adjustment element 5, such as an adjustment motor, and a volume intensification valve 6 which is operatively associated with the pressure adjustment valve 4. The volume intensification valve 6 is located directly in series in the feed line 1 preceded by a pressure limiting valve 7 and a shut off valve 8. The pressure adjustment valve 4 is positioned in parallel with a portion of the feed line between valves 6 and 7. An electrical control interconnection between level sensor 3 and adjusting element 5 is provided by conductors 9. Shut off valve 8 is activated to its closed position in line 1 to terminate inert gas flow only if the current is interrupted or if an emergency switch is switched off.

A check valve 10 is provided in feed line 1 to prevent the return flow of inert gas which has been contaminated by magnesium in the casting furnace. Thus, the check valve is between the furnace and components 4–8 in the feed line. An exhaust line 11 is connected to the feed line between check valve 10 and the furnace and includes two power controlled shut-off valves 20 and 21 between the furnace and the exhaust line outlet. A multi-position sliding discharge valve 12 is located near the outlet of drain line 11, valve 12 having a throttle passage 13 through which flow is constrained by a throttle aperture, and a free passageway 14 through which flow is unconstrained. Discharge valve 12 can be moved by an adjustment mechanism 15 in such a way that either of the apertures 13 or 14 is positioned in the flow passageway to the outlet of exhaust line 11.

Adjustment mechanism 15 is a pneumatically powered piston and cylinder arrangement which is controlled by a solenoid-operated valve 16. Exhaust line 11 is connected to an oxidizing gas line 17 which delivers an oxidizing gas, preferably pressurized air, into the exhaust line between shut off valves 20 and 21. A check valve 18 is provided in the oxidizing gas line to prevent inert gas from entering line 17. A valve 19 in the oxidizing gas line controls the flow of pressurized air into exhaust line 11, valve 19 being preferably a solenoid-operated valve.

Shut-off valves 20 and 21 are connected to line 17 through power-operated valves 20*a* and 21*a*, respectively, and the adjustment mechanism 15 is connected to line 17 through the solenoid operated valve 16 so that the pressurized air which is used for the oxidation of the magnesium is used concurrently as a control medium for the above-mentioned switching elements.

A line 17*a*, which branches off from line 17, is connected to a port of the movable discharge valve 12 and serves to clean aperture 13. Power operated valve 20*a*, associated with bleeder valve 20, check valve 19 and the solenoid operated valve 16 associated with adjustment mechanism 15 are connected to an electrical control line 22 which is energized by a manually or mechanically activated switch 23. For automatic operation, a repeating timer operated relay is connected to switch 23 so that the switch is periodically actuated without manual intervention. Control line 22 is connected to valves 20, 20*a*, 19 and 15 through interlock devices 24. Exhaust line 11 is provided in order to reduce the pressure in the casting apparatus and bleeds through shut-off valves 20 and 21, and aperture 13. The aperture 13 serves to reduce pressure in the casting furnace under controlled conditions as soon as shut off-valve 21 is opened by level control mechanism 2. As a result, this is accomplished as soon as the pressure adjustment valve 4 is set at a lower pressure.

During pressure reduction, magnesium is deposited in the drain line 11 and, particularly, at the aperture 13. Accordingly, the shut off valve 20 is closed periodically by manual or automatic means (that is, by either manual or automatic operation of switch 23) so that the line and aperture 13 can be cleaned and, at the same time, aperture 13 is moved into the cleaning position by adjustment mechanism 15 which positions aperture 13 at the outlet of oxidizing gas line 17*a* whereupon pressurized air or some other oxidizing gas is injected into the drain line 11 by opening control valve 19 and is injected into aperture 13 through line 7*a*. As a result, the deposited magnesium is oxidized (burned). No damage ensues by positioning the free passageway 14 and the aperture 13 and its corresponding configuration and formation at the end of drain line 11 by the magnesium being burned with rapid jet flame. The electrical interlock device 24 assures that the cleaning process can only be initiated when shut-off valve 20 is in its closed position.

The method described herein and the apparatus can also be used if the casting apparatus does not have a plug containment but, instead, casting into moulds is controlled by other means such as, for example, by partial ventilation of the furnace crucible after casting, i.e. raising the fluid metal above or lowering it below the lip of the casting ladle.

While one advantageous embodiment has been chosen to illustrate the invention, it will be understood by those skilled in the art that various changes and modifications can be made therein without departing from the scope of the invention as defined in the appended claims.

What is claimed is:

1. A method of casting iron treated with magnesium in a casting apparatus operated with gas under pressure, the apparatus being of the type having a casting furnace and a piping system for delivering an inert gas under pressure to the casting furnace and wherein inert gas flowing back from the casting furnace is enriched with magnesium, comprising the steps of directing the backflowing inert gas to an exhaust line separated from the remainder of the piping system by the closing of a closable valve element so that magnesium condensing out of the gas is restricted to the exhaust line; and delivering an oxidizing gas to the exhaust line to oxidize condensed magnesium in the exhaust line without interrupting the casting process.

2. A method according to claim 1 wherein the step of oxidizing the condensed magnesium is performed manually.

3. A method according to claim 2 wherein the oxidizing is accomplished by flowing an oxidizing gas through the selected portion of the piping system and concurrently blocking gas flow between the selected poriton and the casting furnace.

4. A method of casting iron treated with magnesium in a casting apparatus operated with gas under pressure, the apparatus being of the type having a casting furnace and a piping system for delivering an inert gas under pressure to the casting furnace and wherein inert gas flowing back from the casting furnace is enriched with magnesium, comprising restricting the backflow of inert gas to a selected, limited portion of the piping system so that magnesium condensing out of the gas is restricted to the selected portion; and periodically oxidizing condensed magnesium in the selected portion of the piping system without interrupting the casting process by automatically flowing an oxidizing gas through the selected portion of the piping system and concurrently blocking gas flow between the selected portion and the casting furnace.

5. An apparatus for casting iron treated with magnesium in an atmosphere of inert gas under pressure comprising the combination of a casting furnace;

a feed line for delivering inert gas to said casting furnace;

level sensor means responsive to melt level in said furnace for producing a feed line pressure control signal;

an exhaust line connected to said feed line and said furnace for removing inert gas from said furnace;

a check valve in said feed line for preventing flow of gas containing magnesium into said feed line from said furnace;

an oxidizing gas line connected to said exhaust line; and means for periodically passing oxidizing gas through said exhaust line to oxidize condensed magnesium in said exhaust line without interrupting the casting of iron.

6. An apparatus according to claim 5 and further comprising a shutoff valve in said exhaust line adjacent said furnace, said oxidizing gas line being connected to said exhaust line at the outlet side of said shutoff valve;

and wherein said oxidizing gas line includes a check valve and a flow control valve before the connection of said oxidizing gas line to said exhaust line.

7. An apparatus according to claim 6 wherein said exhaust line has an outlet, said apparatus further including an adjustment mechanism having a throttle passageway and an unconstrained passageway selectably attachable to said outlet.

8. An apparatus according to claim 7 wherein said throttle passageway is directly connectable to said oxidizing gas line by said adjusting mechanism.

9. An apparatus according to claim 8 and further comprising a second shutoff valve in said exhaust line between the connection to said oxidizing gas line and said outlet, said second shutoff valve having a control input connected to said level sensor.

10. An apparatus according to claim 9 and further comprising an electrical control means for controlling said first shutoff valve, said flow control valve in said oxidizing line and said adjustment mechanism, said control means being selectively activated manually or automatically.

11. An apparatus according to claim 5 wherein said exhaust line has an outlet, said apparatus further including an adjustment mechanism having a throttle passageway and an unconstrained passageway selectably attachable to said outlet.

12. An apparatus according to claim 5 and further comprising a second shutoff valve in said exhaust line between the connection to said oxidizing gas line and said outlet, said second shutoff valve having a control input connected to said level sensor.

* * * * *